US006511066B1

(12) United States Patent
Durrant

(10) Patent No.: US 6,511,066 B1
(45) Date of Patent: Jan. 28, 2003

(54) APPARATUS AND METHOD FOR SCORING DART GAMES

(76) Inventor: Rachon Durrant, 6411 Percival Dr., Riverside, CA (US) 92506

( * ) Notice: Subject to any disclaimer, the term of this patent is extended or adjusted under 35 U.S.C. 154(b) by 0 days.

(21) Appl. No.: 09/699,180

(22) Filed: Oct. 27, 2000

Related U.S. Application Data

(60) Provisional application No. 60/162,185, filed on Oct. 28, 1999.

(51) Int. Cl.[7] ..... A63B 71/06

(52) U.S. Cl. ..... 273/148 R; 273/DIG. 26; 116/222

(58) Field of Search ..... 116/222, 315, 116/321; 235/68, 69, 90, 91 B; 273/148 R, 408, DIG. 26; 434/203, 204

(56) References Cited

U.S. PATENT DOCUMENTS 4,003,579 A 1/1977 Miscavage
4,567,461 A * 1/1986 Honekman et al. .. 273/DIG. 26
5,050,890 A 9/1991 Havens
5,054,792 A 10/1991 Danielson
5,193,817 A 3/1993 Pan
5,438,950 A 8/1995 Rodrigues
5,552,758 A * 9/1996 Tobin ..... 116/222
5,555,840 A 9/1996 Fougere
5,558,337 A 9/1996 Frank, III
5,559,490 A * 9/1996 McDonald et al. ..... 273/317
5,702,102 A * 12/1997 Ballard ..... 116/222
5,850,885 A 12/1998 Clark et al.

* cited by examiner

*Primary Examiner*—Mark S. Graham
(74) *Attorney, Agent, or Firm*—Brown, Martin, Haller & McClain, LLP

(57) ABSTRACT

A dart game scoreboard intended for use in association with regulation size dartboard. The scoreboard contains a removable game piece that allows players to play established dart games such as "cricket" and "301" or "501." Additionally, the removable game piece provides players with the opportunity to play several new games. The scoreboard contains a counter element that allows players to progressively maintain score while playing or compute final scores in games. The combination of the scoreboard's counter feature with the removable game piece allow players the flexibility of playing a variety of games using a single board that additionally maintains score.

8 Claims, 2 Drawing Sheets

APPARATUS AND METHOD FOR SCORING DART GAMES

CROSS-REFERENCES TO RELATED APPLICATIONS

This application claims the benefit of priority of United States provisional application Serial No. 60/162,185 filed Oct. 28, 1999 which is incorporated herein by reference in its entirety.

BACKGROUND OF THE INVENTION

The present invention relates to dart game scoring and is particularly concerned with a dart game scoreboard that combines the flexibility of playing several different dart games with the ability to maintain score on a single scoreboard.

There are several existing ways to play darts that are popular among players. Additionally, new games are continually being created. with this present invention, players can use the scoreboard to keep score while playing games currently known, but also allows for the opportunity of not having to replace the scoreboard as new games are created.

The prior art contains many different games that are played in conjunction with a dart board. However, this invention creates a new scoreboard for existing dart games as well as incorporates a removable game piece that creates additional and new games that may be played and enjoyed by dart players.

SUMMARY OF THE INVENTION

It is an object of the present invention to provide a new and improved dart game scoreboard. It is a further object of the invention to incorporate a new game piece of the scoreboard into new methods of playing dart games.

According to the present invention, the scoreboard frame does not change, but the removable game piece allows for different games to be played using the same scoreboard. The desired game piece is first selected according to the players' wishes. The placement of the game piece into position and secured then identifies to the players which targets they must hit on the dart board. This is accomplished because the face of each game piece provides different vertically aligned symbols that correspond to the various rows of markers. Once the symbols are lined up with the markers, the player then understands which targets to aim for on the dartboard. The removable game pieces dictate the number of players that play and additionally identify which game has been selected in order to know which rules apply. Each game piece face corresponds to a certain game and therefore is guided by that games rules.

The game pieces allows for popularly established as well as new games to be played. For example, the well known game "cricket" can be played by selecting the game piece whose face values descend vertically in the following order: 20, 19, 18, 17, 16, 15, 14, 13, 12, D, T, B. The object of this game is to score three times on the numbers from 20 to 12 including doubles (D), triples (T), and bulls (B). Each time a player hits any of the targets, a marker is moved to signify the completion of that number. The first player to close out all of the numbers wins the game. This is an example of a previously existing game, however, this game can also be varied in order to provide new games.

A shorter version of the game may be played by closing out unwanted numbers before the game begins so that fewer targets are required. Alternatively the game can be played for points by incorporating the counter element of the scoreboard into the game or can be played in sequence. Also the game may be played with three players by using a game piece whose face values descend vertically in the following order: 06, 95, 84, 7B, 06, 95, 84, 7B, 06, 95, 84, 7B. The game is played from 20 to 14 and Bulls with the 06 at the top of each player's zone representing the values 20 and 16. The 20's are scored on the left side and the 16's on the right side. The 95 rows are scored with 19 on the left side and 15 on the right side. The 84 rows are scored with the 18 on the left side and 14 on the right side. Finally, the 7B rows are scored with 17 on the left side and Bulls on the right side.

Alternatively, players may use the counter feature of the scoreboard by choosing to play either the game "501" or "301." These games do not require the use of any game piece, only the use of the counter. This is another well known game where the object is to hit a double space on the dart board and then reduce the players score from the beginning score of either 301 or 501 to a number that can be doubled out on. Use of the counter feature allows for players to maintain score easily while playing without having to either write down the score or remember it mentally.

Other than the existing dartboard games, the different faces on the removable game pieces provide for new games to be played. One example is the game "I can't drive 55." This game is played by selecting the game piece whose face values descend vertically in the following order: 55, 50, 45, 40, 35, 30, 25, 20, 15, 10, 5, B. The object of this game is to score three darts per round whose numerical total equals a multiple of five from five to fifty-five. After all of the numbers from 5 to 55 are closed out the first player to score three Bulls wins the game. The double and triple spaces count as well as the single and double Bulls. When a player scores a number all three beads or counters are moved to the center and that number is closed out.

Another new game is "Even Steven vs. odd Maude." This game requires the use of the game piece whose face values descend vertically in the following order: 20, 18, 16, 14, 12, 10, 8, 6, 4, 2, (space), B. The object of this game is to score three times on all of a players' first numbers (odds or evens). The first player to close out the Bulls wins the game.

The game "Around the world" is played with the game piece whose face values descend vertically in the following order: 1, 2, 3, 4, 5, 6, 7, 8, 9, 10, 11, 12. However, only the values from 1 to 10 are utilized. The object of the game is to be the first player to progress around the board from 1 to 20 and then three Bulls.

The game "Golf" utilizes two different faces of a removable game piece. The face values used for the front nine are 1–9 and 10–18 for the back nine. The object of this game is to shoot a low score and the lowest score wins the round. The player that goes first continues to do so until a hole is lost. The order of play does not change with a tied hole. Scoring for the game is determined by preselecting the par value of the holes. Movement of the counters for each hole depends on par and if the player is above or below par. Following the ninth hole, the players are to tally their score and record it using the counter. Then the back nine holes are played. At the end of the eighteenth hole the scores are added together and the lowest score wins.

The game "Pool-cut throat" is played with three players. The game piece face values descend vertically from 1 to 12. The object of the game is to eliminate your opponents before they eliminate you. The last player standing wins the game. Each player is assigned the three rows of numbers, both the right and left sides. Players use the counters on both sides of their corresponding numbers so that it requires six hits to close out a number. It counts if a player hits their own numbers, and therefore mistakes are costly. When all of the player's numbers are closed out, they are eliminated and the remaining two players continue until another player falls out.

A final new game is "Baseball" which uses the game piece face that displays the numbers 1–9. The object of the game is to score as many runs as possible during the nine inning game. The player with the most runs wins. Innings one through nine correspond to targets 1 to 9 on the dartboard. A player throws each inning until they get three misses which correspond to three outs. The counters represent outs and after three outs a player is to close out the counters for that inning. The runs are to be tallied on each player's counter after each half inning.

The scoreboard apparatus and the changeable game pieces allow players to play traditional and popular games of darts as well as introduce new games into play. The different game piece faces introduce players to a wide variety of never before played games. Additionally, the scoreboard results in both efficiency of calculation of scores as well as incorporation of new games into a single apparatus. Finally, the combination of the counter function with the new games provides for ease of score maintenance and calculation for maximum game enjoyment purposes.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Although an exemplary embodiment of the invention has been described above by way of example only, it will be understood by those skilled in the field that modifications may be made to the disclosed embodiment without departing from the scope of the invention, which is defined by the appended claims.

Figure 1:
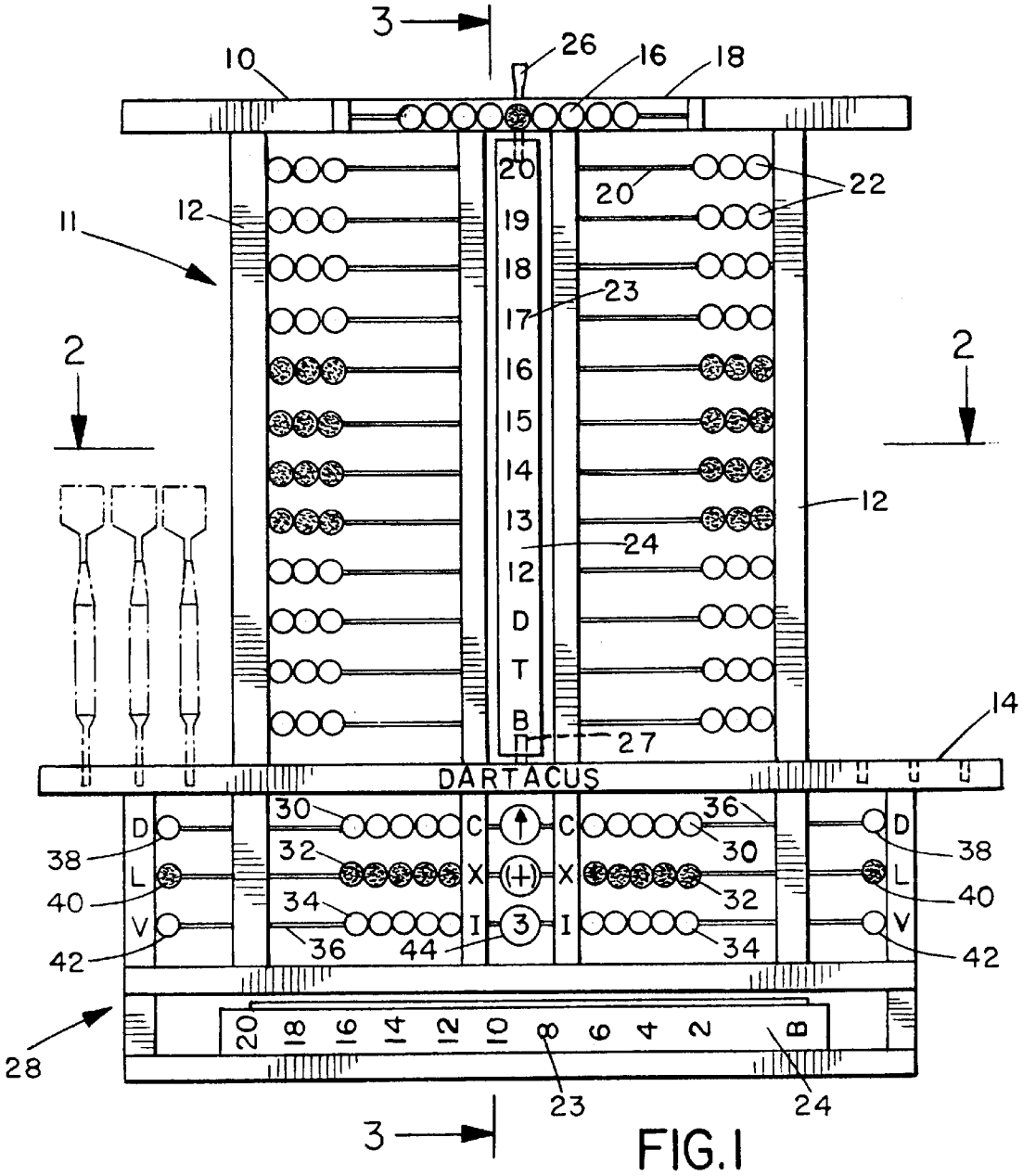
FIG. 1 is a front view of the dart game scoreboard.

FIG. 1 illustrates what a completed scoreboard would look like when in use. The scoreboard is enclosed in a frame that is made of a top member 10, two opposite sides 12, and a base member 14. The top member of the frame contains a game counter element 18 that allows players to maintain count of the number of games won by either player. All the beads 16 are to be positioned in the center of the game counter 18 prior to the beginning of any game. As each player wins a game a bead is moved to signify a win.

On the top 10 and base 14 members of the frame are axles 26, 27 centrally located for engagement of the removable game piece 24 to the scoreboard frame 11. Axle 26 is removable to release the game piece 24. Adjacent to either side of the removable game piece 24 are located rods 20 that are aligned in various rows. These rods 20 align with the indicia 23 on the face of the game pieces 24 in order to allow each player to identify which targets he is required to hit on the dartboard. The rows of rods 20 contain markers in the form of beads 22. At the beginning of the game all of the beads 22 are positioned to one side of rows of rods 20. As the game progresses and each player successfully hits the active targets on the dartboard, then the beads 22 are moved to the opposite side of the rod 20 in order to indicate the completion of that particular target on the dartboard. There are preferably a minimum of twelve rows of rods to accommodate the rules of all the games. The minimum of twelve rows allows for between one and three players to partake in the various dart games.

The counter 28 element of the scoreboard is illustrated as an abacus type counter that is adjacent to the rows of rods 20. The counter 28 is set up so that the bead counters 30, 32, 34, 38, 40, 42, are moved during certain games to calculate a player's score or point total. The bead counters 30, 32, 34, 38, 40, 42, are positioned on rods 36. Each rod 36 has six bead counters 30, 32, 34, 38, 40, 42, that signify various point values. The lowest rod 36 has bead counters 34 that represents single points. The group has five beads 34 that are one point each and the single bead 42 equals five points for a total of ten points. The next rod 36 up represents the ten point row. The five beads 32 are worth ten points each and the single bead 40 equals fifty points. The top row is the one hundred point row. The five beads 30 are one hundred points each and the single bead 38 is worth five hundred points. Therefore, the abacus can score a total of one thousand one hundred and ten points on each side. Between the right and left abacuses are three larger beads 44 that have special functions for certain games.

Figure 2:
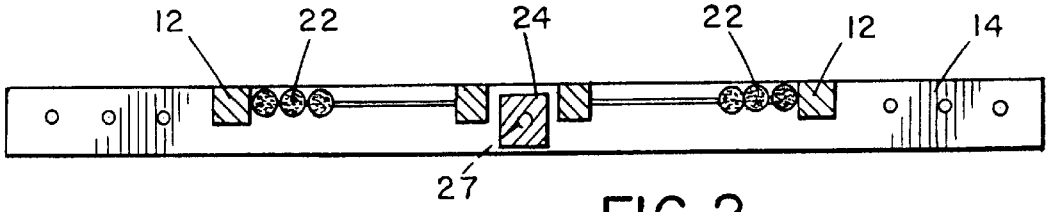
FIG. 2 is a sectional view taken on line 2—2 of FIG. 1.

FIG. 2 represents a sectional view taken on line 2—2 of FIG. 1. This drawing illustrates a cross sectional view of the opposite sides of the scoreboard frame 12, which enclose the beads 22. The removable game piece 24 is located between the rows of rods 20 containing the beads 22. This alignment allows for the removable game piece 24 to be positioned into place and therefore allow proper adjacent alignment of the rows 20 to the indicia on the game piece 24.

Figure 3:
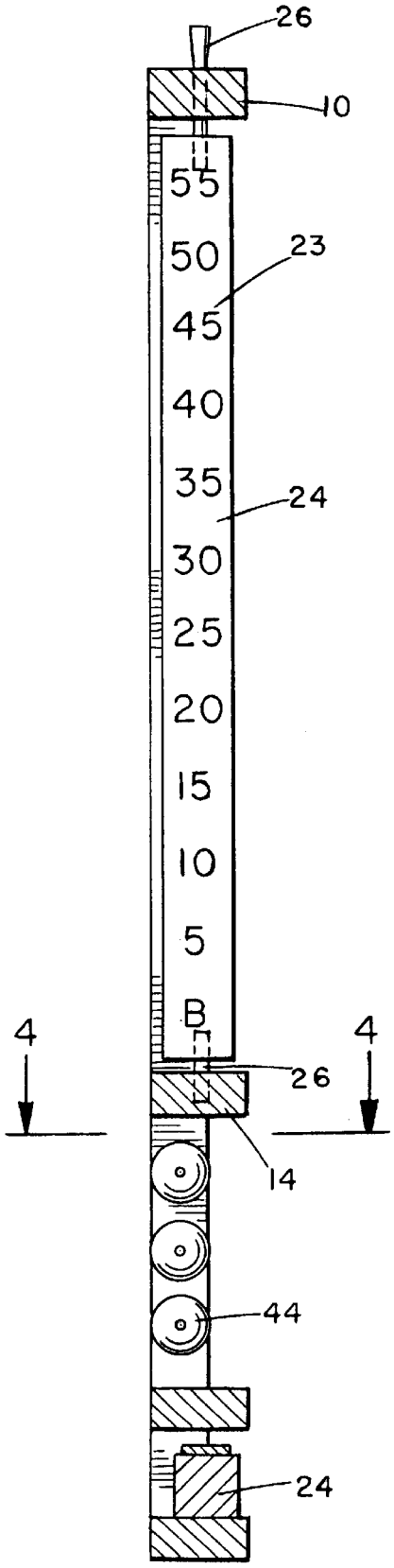
FIG. 3 is a sectional view taken on line 3—3 of FIG. 2.

FIG. 3 is a view of the removable game piece 24 taken on line 3—3 of FIG. 2. The drawing also demonstrates one of the faces of the game piece 24 with the vertical indicia visible 23. The removable game piece 24 is positioned into the scoreboard frame 11 and then connected by the axle 26 for releasable engagement to the scoreboard.

Figure 4:
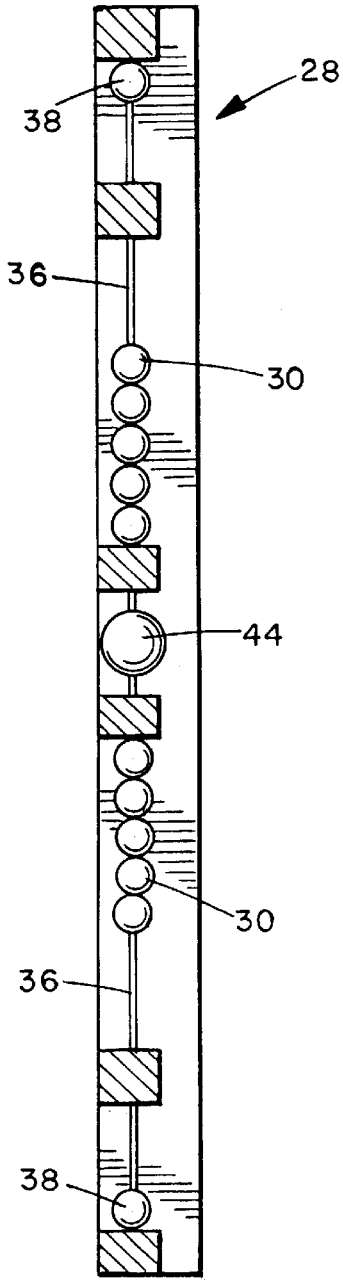
FIG. 4 is a sectional view taken on line 4—4 of FIG. 3.

FIG. 4 is a sectional view taken on line 4—4 of FIG. 3. This drawing illustrates a cross sectional view of the top row of counter beads 30 which represents the hundred value row. The single beads 38 represent a value of five hundred while the remaining grouped beads 30 represent a value of one hundred. The larger beads in the center 44 have special functions for certain games.

In use, the players would first decide which game to play and then select the corresponding game piece 24. The game piece 24 would be inserted into the scoreboard and the vertical indicia 23 would be aligned with the rows of rods 20. The players would then begin to play a game using the dart board. The vertical indicia 23 on the game piece would indicate to the players which targets to aim for on the dartboard.

As each player completes a turn, the appropriate bead 22 from the scoreboard would be moved from a starting position to the opposite side of the rod 20 in order to indicate successful completion of a particular score. If the player did not hit the correct target, the bead 22 would not be moved.

Where appropriate, a player may keep score as the game progresses using the counter 28 element of the board. This is done by sliding the bead counters 30, 32, 34, 38, 40, 42 to the opposite side of the rod 36. Each bead corresponds to a particular value in order to maintain score in various incremental values.

At the completion of each game, the player that won the game uses the game counter element 18 to keep track of the number of games won. This is done by beginning with the beads 16 in the center of the game counter and then sliding the bead 16 towards the opposite side once a game has been won. Once a game is finished, the players may decide to play again or alternatively to change the game by switching the game piece.

I claim:

1. An apparatus for use by at least one player in the scoring of a dart game played on a dart board comprising:

a plurality of rows of markers that signify the value of a score determined by the position of a dart on the dartboard;

a changeable game determining piece having at least one set of vertically aligned indicia that correspond to adjacent rows of markers;

a counter adjacent to the rows of markers that is associated with each player;

wherein the rows of markers are contained within a frame, the frame having a top, a base, and opposite sides; and wherein the top and base frames each contain an axle for releasable engagement to the game determining piece.

2. The apparatus as claimed in claim 1, wherein the top of the frame has an element that maintains record of the number of games each player has won.

3. The apparatus as claimed in claim 1, wherein the game determining piece has a plurality of faces with different indicia that correspond to various games.

4. The apparatus as claimed in claim 1, wherein the counter is used for determining the instantaneous or total score of each player.

5. An apparatus for use by at least one player in the scoring of a dart game played on a dart board comprising:

a changeable game determining piece having at least one set of vertically aligned indicia that correspond to a plurality of rows of markers that are adjacent to the game determining piece;

the plurality of rows of markers signify the value of a score determined by the position of a dart on the dartboard, the rows of markers comprising rows of rods with a plurality of slidable counter beads;

a counter adjacent to the rows of markers that is associated with each player;

wherein the rows of markers are contained within a frame, the frame having a top, a base, and opposite sides; and wherein the base and top of the frame each contain an axle for releasable engagement to the game determining piece.

6. The apparatus as claimed in claim 5, wherein the top of the frame has an element that maintains record of the number of games each player has won.

7. The apparatus as claimed in claim 5, wherein the counter can minimally keep score to five hundred and one.

8. A method of scoring dart games on a scoreboard by a player comprising:

selecting a game determining piece that corresponds to a desired game and then positioning in the scoreboard the game determining piece adjacent to a row of markers that determines which targets on a dart board are desired;

providing the scoreboard with a plurality of rows of markers that signify the value of a score determined by the position of a dart on the dartboard, the rows of markers are contained within a frame having a top, a base, and opposite sides, the top and base frames each containing an axle for releasable engagement to the game determining piece;

throwing a dart onto a dart board to determine the target's value;

moving the marker within the scoreboard in the row that corresponds to the target value and aligns with an equivalent game determining piece value after each players' turn;

using the counter to calculate progressive or final scores of the game;

using the final score of the counter or the positioning of the markers to determine the winner.

* * * * *